US009022248B2

(12) United States Patent
Vandenlangenberg

(10) Patent No.: US 9,022,248 B2
(45) Date of Patent: May 5, 2015

(54) PORTABLE BEVERAGE CONTAINER WITH A PERMANENT NEOPRENE COVER

(76) Inventor: Gary Vandenlangenberg, Rancho Cucamonga, CA (US)

( * ) Notice: Subject to any disclaimer, the term of this patent is extended or adjusted under 35 U.S.C. 154(b) by 215 days.

(21) Appl. No.: 13/526,940

(22) Filed: Jun. 19, 2012

(65) Prior Publication Data

US 2013/0334233 A1 Dec. 19, 2013

(51) Int. Cl.
*B65D 81/38* (2006.01)

(52) U.S. Cl.
CPC ..... *B65D 81/3876* (2013.01)

(58) Field of Classification Search
CPC .. B65D 81/38; B65D 81/383; B65D 81/3841; B65D 81/3869; B65D 81/3881; B65D 81/3865; A47J 41/00; A47J 41/02; A47J 41/022
USPC ..... 220/592.16, 592.17, 592.27, 62.12, 220/62.4; 215/12.1, 13.1
See application file for complete search history.

(56) References Cited

U.S. PATENT DOCUMENTS 4,299,100 A * 11/1981 Crisman et al. ..... 62/457.4
5,531,353 A * 7/1996 Ward et al. ..... 220/729
5,593,053 A * 1/1997 Kaufman et al. ..... 215/12.1
5,727,709 A * 3/1998 Nobile ..... 220/560
6,041,952 A * 3/2000 Martin ..... 215/12.1
6,059,140 A * 5/2000 Hicks ..... 220/739
6,398,065 B1 * 6/2002 Lewis ..... 220/737
6,467,644 B1 * 10/2002 Yeh ..... 220/592.17
D500,231 S * 12/2004 Ward et al. ..... D7/608
7,198,171 B2 * 4/2007 Liu ..... 220/759
7,878,365 B1 * 2/2011 Meehan ..... 220/737
2002/0104845 A1 * 8/2002 Beuke ..... 220/739
2008/0272118 A1 * 11/2008 Wang Wu ..... 220/62.12
2011/0062154 A1 * 3/2011 Rhee ..... 220/62.12

* cited by examiner

*Primary Examiner* — Anthony Stashick
*Assistant Examiner* — Ernesto Grano

(57) ABSTRACT

The present invention is a portable beverage container with a permanent neoprene cover. The container has a vessel, a permanent neoprene cover, a weight, a bottom cover, a protective rubber bottom and a lid. The permanent neoprene is made of neoprene wetsuit material or other closed cell foam rubber for enhanced insulation. The permanent neoprene cover has a laminated fabric cover whereon any printed image can printed upon. The permanent neoprene cover is capped by an overarching rim and a bottom rim of the bottom cover. The protective rubber bottom of the container is a self-adhered cup coaster which prevents the condensation of the liquid from permeating therethrough. The container further comprises a flathead screw which attaches the bottom cover to the weight and the bottom of the vessel. Together with the neoprene wetsuit material, protective rubber bottom, and the lid, the container is therefore a convenient insulated beverage container.

10 Claims, 9 Drawing Sheets

PORTABLE BEVERAGE CONTAINER WITH A PERMANENT NEOPRENE COVER

FIELD OF THE INVENTION

The present invention relates generally to portable beverage containers.

BACKGROUND OF THE INVENTION

Modern-day lifestyles are increasingly mobile. One of the common items carried on the go is a portable beverage container. Common portable beverage containers can store a variety of liquids, which can either be hot or cold. The preservation of the temperature of the fluid therein is enhanced when the portable beverage container is sheathed with an insulating material and capped with a spill-proof top. The insulating material allows the portable beverage container to perpetuate the temperature of the contained fluid. Therefore, the temperature of the beverage will stay stable throughout the consumption period. The spill-proof top of the container prevents content within from spilling out thereof. The present invention is a portable beverage container with a neoprene wetsuit insulating material and a spill-proof lid, which prevents the content from spilling out thereof.

DETAILED DESCRIPTION OF THE INVENTION

Figure 1:
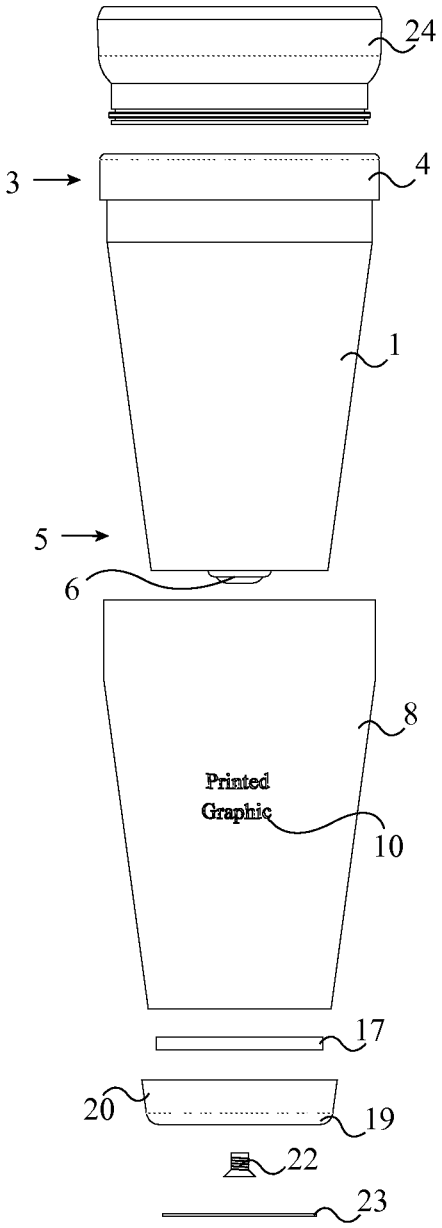
FIG. 1 is a front exploded view of the present invention.
Figure 2:
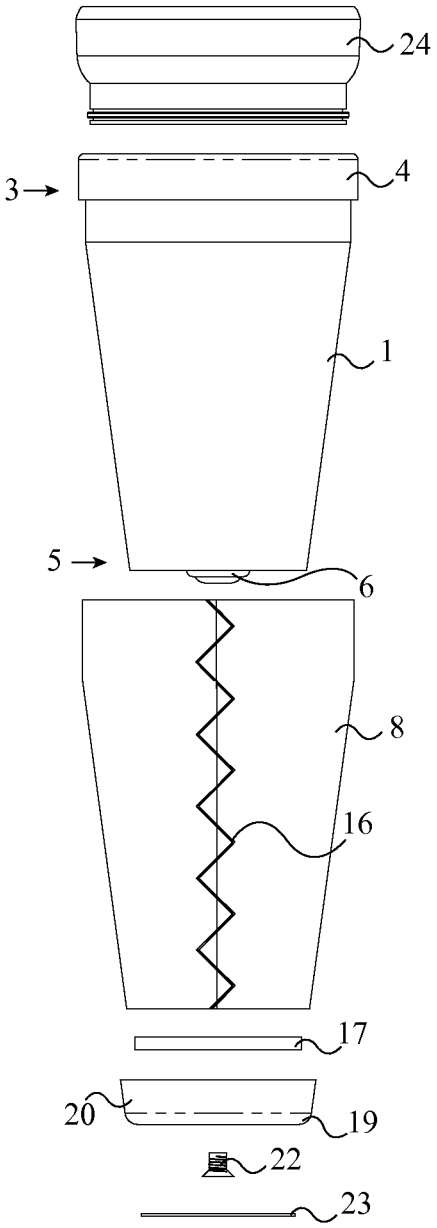
FIG. 2 is a back exploded view of the present invention.
Figure 3:
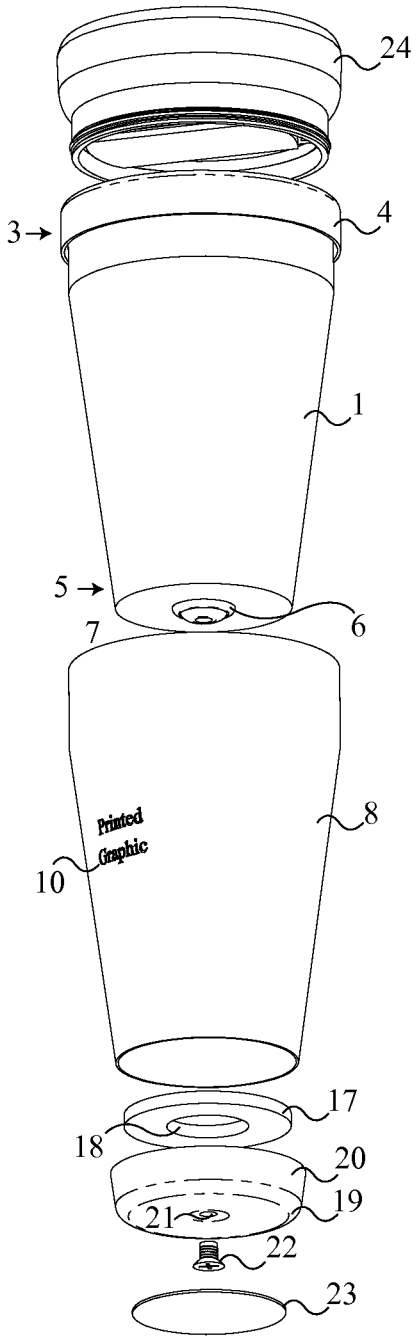
FIG. 3 is a bottom exploded view of the present invention illustrating the holes thereof.
Figure 4:
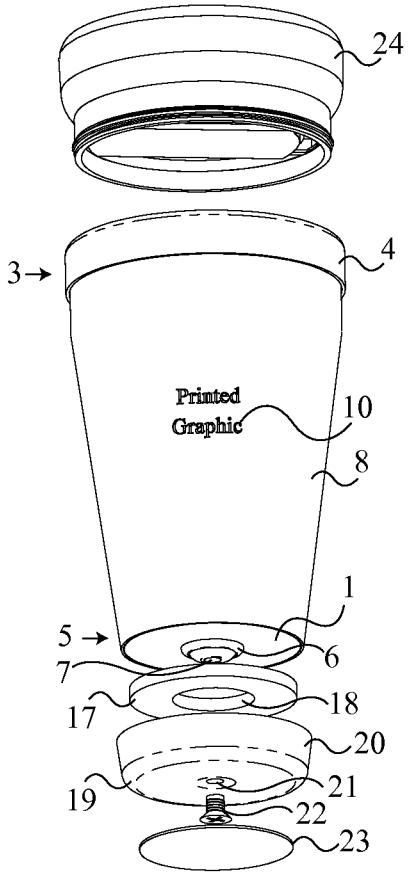
FIG. 4 is a bottom exploded view of the present invention with the permanent neoprene cover sheathing the vessel.
Figure 5:
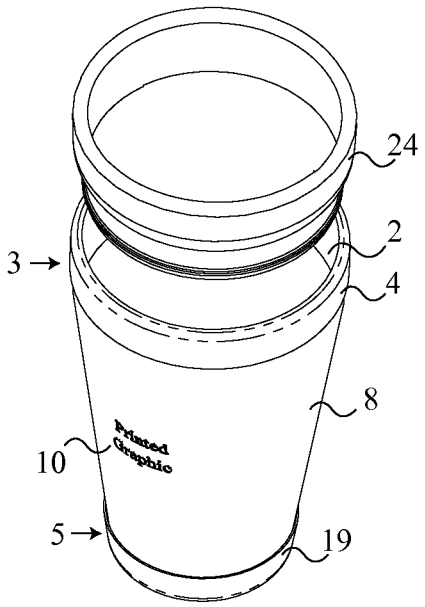
FIG. 5 is a top perspective view of the present invention.
Figure 6:
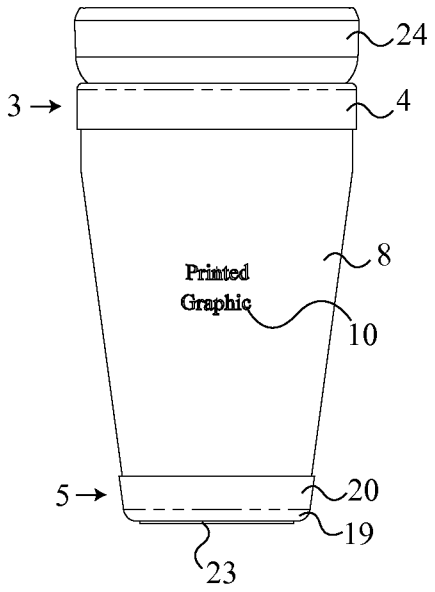
FIG. 6 is a front view of an assembled embodiment of the present invention.
Figure 7:
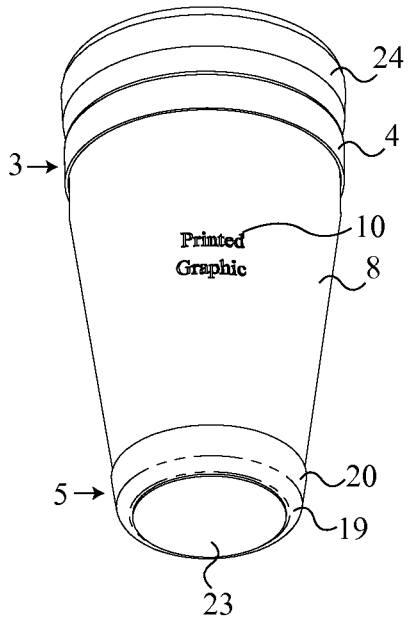
FIG. 7 is a bottom view of the assembled embodiment of the present invention.

All illustrations of the drawings are for the purpose of describing selected versions of the present invention and are not intended to limit the scope of the present invention.

The present invention is a portable beverage container with a permanent neoprene cover. The present invention is utilized to store and carry beverages. As illustrated from FIG. 1 through FIG. 5, an amount of a beverage is contained within a hollow space 2 of a vessel 1 of the present invention. The vessel 1 of the present invention is a container comprising the hollow space 2, an overarching rim 4, a vessel top 3, a vessel bottom 5 and an attachment joint 6. The hollow space 2 is a capaciously empty cylindrical volume situated within a cylindrical body of the vessel 1. The hollow space 2 is capable of storing not only fluidic materials but also solid objects containable therewithin. The overarching rim 4 of the vessel 1 is a circular rim continuous with the cylindrical body of the vessel 1. Specifically, the overarching rim 4 is continuous with the tubular wall of the vessel 1 in a manner wherein the tubular wall curls and overarches at the vessel top 3 to form the overarching rim 4. The overarching rim 4 is part of the vessel top 3 of the present invention. The vessel top 3 comprises the overarching rim 4 and the top lateral face of the hollow space 2. Furthermore, the vessel top 3 is where a lid 24 of the present invention is engaged thereto. The vessel bottom 5 of the present invention is a flat base positioned perpendicular to the cylindrical body of the vessel 1. In the preferred embodiment, the present invention is shorter than similar inventions, but the present invention still comprises an industry average capacity of 16 ounces. Connected and positioned centrally to the vessel bottom 5 is an attachment joint 6. In the preferred embodiment, the attachment joint 6 is a dome-like structure located centered and at the vessel bottom 5. Positioned centrally on the attachment joint 6 is a vessel screw hole 7, which traverses into the attachment joint 6 thereof. The vessel screw hole 7 allows a permanent neoprene cover 8, a weight 17, a bottom cover 19, a flathead screw 22 and consequently a protective rubber bottom 23 to be attached to the vessel bottom 5. The vessel 1, the permanent neoprene cover 8, the weight 17, the bottom cover 19, the flathead screw 22, the lid 24 and the protective rubber bottom 23 are serially, collinearly and concentrically positioned to each other.

Figure 9:
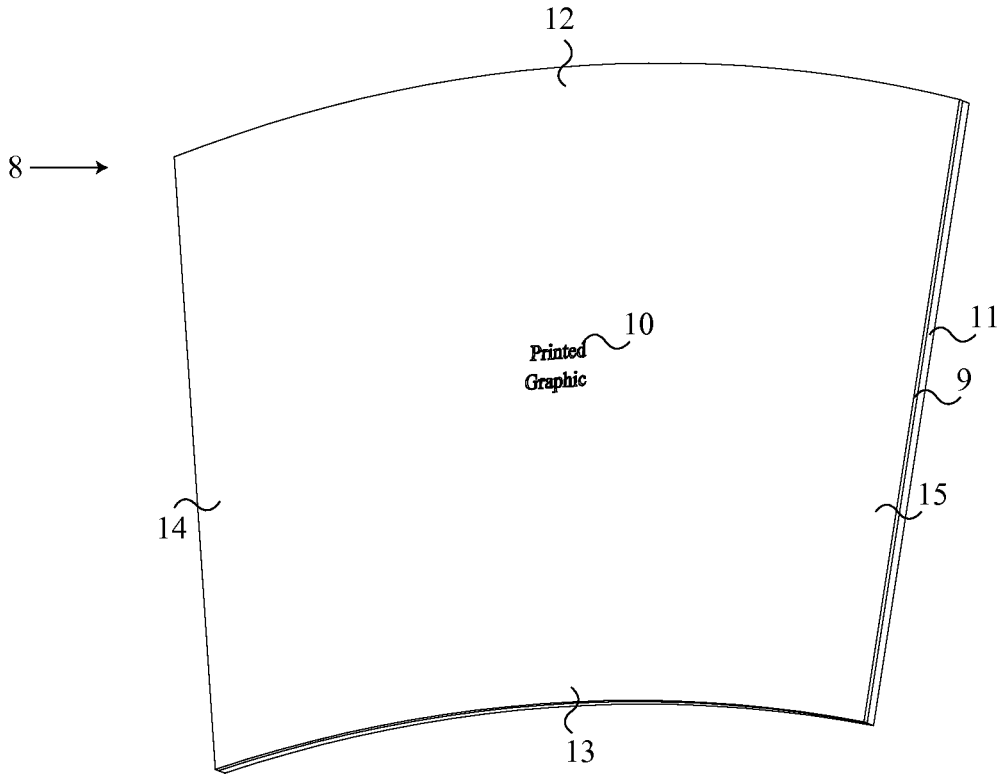
FIG. 9 is a view of a flat permanent neoprene cover.

As illustrated in FIG. 9, the permanent neoprene cover 8 is the most unique aspect of the present invention. The present invention differs from similar inventions in that the permanent neoprene cover 8 is permanently affixed to the vessel 1. The vessel 1 is sheathed by the permanent neoprene cover 8. Furthermore, the permanent neoprene cover 8 covers the entire lateral surface of the cylindrical body of the vessel 1. In addition to completely covering the vessel 1, a top edge 12 of the permanent neoprene cover 8 is sealed underneath the overarching rim 4 while a bottom edge 13 of the permanent neoprene cover 8 is sealed underneath a bottom rim 20 of the bottom cover 19. Since the permanent neoprene cover 8 is situated between the overarching rim 4 and the bottom rim 20, the top edge 12 of the permanent neoprene is encircled by the overarching rim 4 and the bottom edge 13 is encircled by the bottom rim 20. Both of the overarching rim 4 and the bottom rim 20 cap the permanent neoprene cover 8 in place and keep the permanent neoprene cover 8 affixed circumferentially and laterally to the vessel 1 thereof. Therefore, the permanent neoprene cover 8 is permanently installed and integrated into the present invention. The addition of the permanent neoprene cover 8 to the present invention is both functional and aesthetic. The permanent neoprene cover 8 comprises a neoprene wetsuit material or other closed cell foam rubber 11 and a laminated fabric cover 9.

The neoprene wetsuit material or other closed cell foam rubber 11, is an excellent insulating material for both hot and cold beverages. The neoprene wetsuit material or other closed cell foam rubber 11 is closed cell neoprene or similar closed cell rubber material such as styrene-butadiene rubber and neoprene mix. Since the closed cells offer superior insulation and waterproofing, the neoprene wetsuit material or other closed cell foam rubber 11 is a naturally water-proof and non-absorbent material, which is what diving wetsuits are made of. While not dishwasher safe, the neoprene wetsuit material or other closed cell foam rubber 11 and thus the permanent neoprene cover 8 is low maintenance, stain-resistant and water-proof. It has been found that polyester and nylon laminated permanent neoprene covers are heavily water and stain resistant. Because of the excellent insulating properties of the neoprene wetsuit material or other closed cell foam rubber 11, exterior sweating is eliminated from the present invention. Along with the permanent neoprene cover 8, the present invention also comprises the protective rubber bottom 23 which serves as a coaster to eliminate moisture from permeating out of the vessel bottom 5. Therefore, the present invention is 100 percent sweat proof. The protective rubber bottom 23 is centrally adhered to the bottom cover 19, covering the flathead screw 22 attached thereto.

Figure 8:
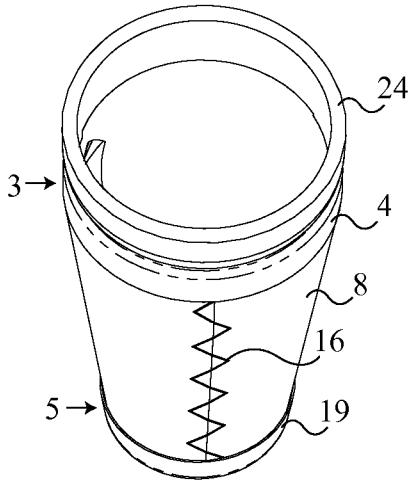
FIG. 8 is a top perspective view of the assembled embodiment of the present invention.

The outer surface of the permanent neoprene cover 8 is the laminated fabric cover 9, which has been laminated onto the neoprene wetsuit material or other closed cell foam rubber 11 as illustrated in FIG. 9. The cloth fabric of the laminated fabric cover can be decorated with a printed graphic 10. The printed graphic 10 is any arbitrary image that can normally be printed on paper. Cotton, polyester, and nylon fabric laminations allow for various types of decorations such as full-bleed printing, which is full color printing by sublimation or screen printing. In full-bleed printing, the permanent neoprene cover 8 has been flattened out into a flat panel which is printed from top to bottom, left to right, and beyond the edge of the fabric. In the preferred embodiment, the laminated fabric cover 9 initially was white before printing, but any solid color can be printed upon. Once a first end 14 of the permanent neoprene cover 8 and a second end 15 of the permanent neoprene cover 8 are sewn together by a stitch pattern 16, the first end 14 of the permanent neoprene cover 8 and the second end 15 of the permanent neoprene cover 8 completely cover the vessel 1 therewithin. The stitch pattern is present in FIG. 2 and FIG. 8. In the preferred embodiment, the permanent neoprene cover 8 has been stitched into a cone shape by a butt-seam stitch pattern. The butt-seam stitch pattern has been accomplished by utilizing a flat-lock or zigzag sewing machine. In addition to full-bleed printing, the laminated fabric cover can be further decorated with direct embroideries, iron-on embroidered patches, iron-on heat transfers, iron-on metal studs, iron-on crystals such as rhinestones or any combination thereof. The laminated fabric cover 9 provides the user a soft and secure sensation while holding the present invention. The secure sensation experienced by the user is due to the permanent neoprene cover 8 covering the entire lateral surface of the vessel 1.

The weight 17 of the present invention adds weight to the vessel bottom 5 of the present invention. With the weight 17 attached to the vessel bottom 5, the present invention will not likely to topple over. Thus, the present invention will not have a "top heavy" problem which is common with tall travel mugs or tall drink cups. In the preferred embodiment, the weight 17 is 3 ounces or more. Along with the weight 17 and a shorter height, the stability of the present invention is enhanced. In the preferred embodiment, the weight 17 is a circular metal washer or other metal slug with a weight hole 18 centrally traversing therethrough. The weight hole 18 is circular and cylindrically bodied. The weight 17 is attached to the vessel bottom 5 in a manner wherein the weight hole 18 is concentrically positioned with the attachment joint 6 and the vessel screw hole 7 located on the vessel bottom 5. With the weight 17 concentrically attached to the vessel bottom 5, the bottom cover 19 is concentrically positioned and attached to the weight 17 and the vessel bottom 5 thereof. The bottom cover 19 completely covers the weight 17, the attachment joint 6 and the vessel bottom 5 of the present invention. The attachment of the bottom cover 19 to the weight 17, the attachment joint 6, and the vessel bottom 5 is facilitated by the attachment of the bottom rim 20 to the circumference of the vessel bottom 5 and the attachment of the flathead screw 22 to the vessel screw hole 7 of the attachment joint 6. As mentioned before, the bottom rim 20 of the bottom cover 19 caps the bottom edge 13 of the permanent neoprene cover 8. The flathead screw 22 allows the bottom cover 19 to be permanently attached to the vessel bottom 5. The flathead screw 22 attaches to the bottom cover 19 by penetrating through a bottom screw hole 21, which is positioned centrally on the bottom cover 19. The flathead attaches to the bottom cover 19 in a manner wherein the flathead screw 22 is flush with the bottom cover 19, leaving no protrusion out thereof. The weight hole 18 of the weight 17 centrally traverses through the weight 17. The bottom screw hole 21 of the bottom cover 19 centrally traverses through the bottom cover 19. The vessel screw hole 7 centrally traverses into the attachment joint 6. Therefore, the flathead screw 22 traverses through the bottom screw hole 21, the weight hole 18, and into the vessel screw hole 7. The weight 17 is positioned below the vessel bottom 5 with the bottom cover 19 being positioned below the weight 17. Adhered over the bottom cover 19 and the flathead screw 22 is the protective rubber bottom 23, which is affixed thereto. In the preferred embodiment, the material of the protective rubber bottom 23 is high density foam or soft rubber compound. Similar to the bottom cover 19, the weight 17, the weight hole 18, the bottom rim 20, the bottom screw hole 21, and the flathead screw 22, the protective rubber bottom 23 is centrally and concentrically positioned on the vessel bottom 5.

With a spill-proof top, Because the vessel 1 of the present invention is leak-proof, the temperature of the content will be preserved for a long period of time. The impermeability of fluids into the vessel 1 makes the present invention an ideal beverage container for either hot or cold beverages wherein the temperature of the content must be preserved for enjoyable consumption. The manufacturing technique of the present invention is also applied to travel mugs, drinking cups, shot glasses, whiskey glasses, coffee mugs, and cocktail shakers.

Although the invention has been explained in relation to its preferred embodiment, it is to be understood that many other possible modifications and variations can be made without departing from the spirit and scope of the invention as hereinafter claimed.

What is claimed is:

1. A portable beverage container with a permanent neoprene cover comprises, a vessel;

a permanent neoprene cover;

a weight;

a bottom cover;

a flathead screw;

a protective rubber bottom;

the vessel comprising a hollow space, a vessel top, and a vessel bottom;

the vessel top comprising an overarching rim;

the vessel bottom comprising an attachment joint and a vessel screw hole;

the permanent neoprene cover comprising a laminated fabric cover, a neoprene wetsuit material, a top edge, a bottom edge, a first end, a second end and a stitch pattern;

the weight comprising a weight hole;

the bottom cover comprising a bottom rim and a bottom screw hole;

the vessel, the permanent neoprene cover, the weight, the bottom cover, the flathead screw, a lid and the protective rubber bottom being serially positioned to each other;

the vessel, the permanent neoprene cover, the weight, the bottom cover, the flathead screw, the lid and the protective rubber bottom being collinearly positioned to each other;

the vessel, the permanent neoprene cover, the weight, the bottom cover, the flathead screw, the lid and the protective rubber bottom being concentrically positioned to each other;

the permanent neoprene cover being affixed circumferentially and axially to the vessel and being situated only between the overarching rim and the bottom rim;
the weight hole centrally traversing through the weight;
the bottom screw hole centrally traversing through the bottom cover;
the vessel screw hole centrally traversing into the attachment joint;
the flathead screw traversing through the bottom screw hole;
the flathead screw traversing through the weight hole;
the flathead screw traversing into the vessel screw hole;
the attachment joint being centrally positioned on the vessel bottom;
the weight being positioned below the vessel bottom;
the bottom cover being positioned below the weight; and
the protective rubber bottom being adhered below the bottom cover.

2. The portable beverage container with a permanent neoprene cover as claimed in claim 1 comprises,
the top edge being encircled by the overarching rim; and
the bottom edge being encircled by the bottom rim.

3. The portable beverage container with a permanent neoprene cover as claimed in claim 1 comprises,
the first end and the second end being connected via the stitch pattern.

4. The portable beverage container with a permanent neoprene cover as claimed in claim 3, wherein the stitch pattern is a butt-seam stitch pattern.

5. The portable beverage container with a permanent neoprene cover as claimed in claim 1, wherein the laminated fabric cover comprising a printed graphic.

6. The portable beverage container with a permanent neoprene cover as claimed in claim 5, wherein the printed graphic is a full-bleed print.

7. A portable beverage container with a permanent neoprene cover comprises,
a vessel;
a permanent neoprene cover;
a weight;
a bottom cover;
a flathead screw;
a protective rubber bottom;
the vessel comprising a hollow space, a vessel top, and a vessel bottom;
the vessel top comprising an overarching rim;
the vessel bottom comprising an attachment joint and a vessel screw hole;
the permanent neoprene cover comprising a laminated fabric cover, a neoprene wetsuit material, a top edge, a bottom edge, a first end, a second end and a stitch pattern;
the weight comprising a weight hole;
the bottom cover comprising a bottom rim and a bottom screw hole;
the vessel, the permanent neoprene cover, the weight, the bottom cover, the flathead screw, a lid and the protective rubber bottom being serially positioned to each other;
the vessel, the permanent neoprene cover, the weight, the bottom cover, the flathead screw, the lid and the protective rubber bottom being collinearly positioned to each other;
the vessel, the permanent neoprene cover, the weight, the bottom cover, the flathead screw, the lid and the protective rubber bottom being concentrically positioned to each other;
the permanent neoprene cover being affixed circumferentially and axially to the vessel;
the permanent neoprene cover being situated only between the overarching rim and the bottom rim;
the top edge being encircled by the overarching rim;
the bottom edge being encircled by the bottom rim;
the weight hole centrally traversing through the weight;
the bottom screw hole centrally traversing through the bottom cover;
the vessel screw hole centrally traversing into the attachment joint;
the attachment joint being centrally positioned on the vessel bottom;
the weight being positioned below the vessel bottom;
the bottom cover being positioned below the weight;
the protective rubber bottom being adhered below the bottom cover;
the first end and the second end being connected via the stitch pattern;
the laminated fabric cover comprising a printed graphic;
the flathead screw traversing through the bottom screw hole;
the flathead screw traversing through the weight hole; and
the flathead screw traversing into the vessel screw hole.

8. The portable beverage container with a permanent neoprene cover as claimed in claim 7, wherein the stitch pattern is a butt-seam stitch pattern.

9. The portable beverage container with a permanent neoprene cover as claimed in claim 7, wherein the printed graphic is a full-bleed print.

10. A portable beverage container with a permanent neoprene cover comprises,
a vessel;
a permanent neoprene cover;
a weight;
a bottom cover;
a flathead screw;
a protective rubber bottom;
the vessel comprising a hollow space, a vessel top, and a vessel bottom;
the vessel top comprising an overarching rim;
the vessel bottom comprising an attachment joint and a vessel screw hole;
the permanent neoprene cover comprising a laminated fabric cover, a neoprene wetsuit material, a top edge, a bottom edge, a first end, a second end and a stitch pattern;
the weight comprising a weight hole;
the bottom cover comprising a bottom rim and a bottom screw hole;
the vessel, the permanent neoprene cover, the weight, the bottom cover, the flathead screw, a lid and the protective rubber bottom being serially positioned to each other;
the vessel, the permanent neoprene cover, the weight, the bottom cover, the flathead screw, the lid and the protective rubber bottom being collinearly positioned to each other;
the vessel, the permanent neoprene cover, the weight, the bottom cover, the flathead screw, the lid and the protective rubber bottom being concentrically positioned to each other;
the permanent neoprene cover being affixed circumferentially and axially to the vessel;
the permanent neoprene cover being situated only between the overarching rim and the bottom rim;
the top edge being encircled by the overarching rim;
the bottom edge being encircled by the bottom rim;

the weight hole centrally traversing through the weight;
the bottom screw hole centrally traversing through the bottom cover;
the vessel screw hole centrally traversing into the attachment joint;
the attachment joint being centrally positioned on the vessel bottom;
the weight being positioned below the vessel bottom;
the bottom cover being positioned below the weight;
the protective rubber bottom being adhered below the bottom cover;
the first end and the second end being connected via the stitch pattern;
the stitch pattern being a butt-seam stitch pattern;
the laminated fabric cover comprising a printed graphic;
the printed graphic being a full-bleed print;
the flathead screw traversing through the bottom screw hole;
the flathead screw traversing through the weight hole; and
the flathead screw traversing into the vessel screw hole.

* * * * *